US008499853B2

(12) United States Patent
Spirer

(10) Patent No.: US 8,499,853 B2
(45) Date of Patent: Aug. 6, 2013

(54) APPARATUS AND METHODS FOR CONTROLLING HYDRAULICALLY POWERED EQUIPMENT

(75) Inventor: Steven E. Spirer, Woodcliff Lake, NJ (US)

(73) Assignee: Norwolf Tool Works, Inc., Westwood, NJ (US)

( * ) Notice: Subject to any disclaimer, the term of this patent is extended or adjusted under 35 U.S.C. 154(b) by 372 days.

(21) Appl. No.: 12/619,108

(22) Filed: Nov. 16, 2009

(65) Prior Publication Data

US 2011/0114344 A1 May 19, 2011

(51) Int. Cl.
*B25B 13/46* (2006.01)

(52) U.S. Cl.
USPC ..... 173/217; 173/213

(58) Field of Classification Search
USPC ..... 173/213, 218, 217; 81/57.39, 57.44
See application file for complete search history.

(56) References Cited

U.S. PATENT DOCUMENTS

| | | | | | |
|---|---|---|---|---|---|
| 3,739,663 | A * | 6/1973 | Wilms | 81/57.39 |
| 4,233,865 | A * | 11/1980 | Junkers | 81/57.44 |
| 4,339,968 | A * | 7/1982 | Krieger | 81/57.39 |
| 4,458,563 | A * | 7/1984 | Bickford et al. | 81/57.39 |
| 4,765,210 | A * | 8/1988 | Mierbach et al. | 81/57.39 |
| 4,794,825 | A * | 1/1989 | Schmoyer | 81/57.39 |
| 4,805,496 | A * | 2/1989 | Wagner et al. | 81/57.39 |
| 5,311,796 | A * | 5/1994 | Junkers | 81/57.39 |
| 5,311,797 | A * | 5/1994 | Ruessmann et al. | 81/57.39 |
| 5,373,759 | A * | 12/1994 | Sergan | 81/57.39 |
| 5,979,273 | A * | 11/1999 | Walton | 81/57.39 |
| 6,029,546 | A * | 2/2000 | Gibson et al. | 81/57.44 |
| 6,260,443 | B1 * | 7/2001 | Spirer | 81/57.39 |
| 6,279,427 | B1 * | 8/2001 | Francis | 81/57.39 |
| 6,681,870 | B1 * | 1/2004 | Culverwell | 173/213 |
| 6,802,235 | B2 * | 10/2004 | Junkers et al. | 81/57.39 |
| 7,082,858 | B2 * | 8/2006 | Knopp et al. | 81/57.39 |
| 7,520,128 | B1 * | 4/2009 | Rosa et al. | 60/379 |
| 2004/0060397 | A1 * | 4/2004 | More | 81/57.39 |
| 2006/0053981 | A1 * | 3/2006 | Shaw et al. | 81/57.39 |

FOREIGN PATENT DOCUMENTS

EP 324050 A1 * 7/1989

* cited by examiner

*Primary Examiner* — Brian D Nash
(74) *Attorney, Agent, or Firm* — Kaplan Breyer Schwarz & Ottesen, LLP

(57) ABSTRACT

A wrench is disclosed which provides a hydraulically powered ratchet wrench within a compact footprint. One hydraulically powered piston operates to tighten a fastener, while a second hydraulic piston is operable to reset the first piston in preparation for a subsequent tightening operation. An intermediary torque multiplying device may be placed between the driven pistons and the object being acted upon by the pistons. Fluid supply hoses may be coupled to the wrench assembly using a two-axis swivel to facilitate insertion of the wrench assembly into areas that are difficult to access.

6 Claims, 5 Drawing Sheets

APPARATUS AND METHODS FOR CONTROLLING HYDRAULICALLY POWERED EQUIPMENT

CROSS-REFERENCE TO RELATED APPLICATIONS

The disclosure of U.S. Pat. No. 6,260,443, to Spirer, issued Jul. 17, 2001, is hereby incorporated by reference herein in its entirety.

BACKGROUND OF THE INVENTION

Hydraulically powered wrenches are known in the art. In one existing system, a linear hydraulic piston turns a link plate, which in turn causes a lever arm having a spring-loaded pawl thereon to rotate and thereby impart torque to a fastener having teeth that engage the pawl. Spring action may then be used to transmit force through the drive train of the apparatus to reset the position of the piston. Thus, hydraulic force to the piston may be released, whereupon a spring may force the link plate and lever arm to retrace the motion undertaken during the piston stroke. During the spring-forced movement of the link plate and lever arm, the pawl reverses its motion with respect to the teeth on the driven member using a conventional ratcheting function. Once the spring driven stroke is complete, the entire mechanism is ready for the next piston power stroke to turn the driven member again. The above cycle may be repeated as many times as needed to complete a tightening function or any other desired operation.

A problem with the above approach is that spring-driven repositioning systems tend to be slow. Moreover, the piston-repositioning spring may weaken over time. Once this occurs, the repositioning spring may become incapable of properly repositioning the linkage to be powered by the piston, thus rendering the overall apparatus inoperable. Moreover, repairing or replacing the spring is expensive and time consuming.

Another approach to using hydraulic power for high-torque wrenches involves providing two fluid inputs to a cylinder, one on either side of the piston. A first fluid inlet at a proximal end of the cylinder is used to force the piston in a first direction to deliver tightening force through the linkage (discussed above) to a driven member. The equipment is moved in the reverse direction to reset the pawl and the position of the piston by providing pressurized fluid to a second fluid inlet to the cylinder at the distal end of the cylinder to force the piston into a retracted position.

However, this approach also presents drawbacks. Providing and servicing the described second fluid inlet to the cylinder is cumbersome and expensive. Moreover, when operating within a confined space, extending pressurized fluid tubes to the second fluid inlet tends to be cumbersome and to inhibit optimal operation of a hydraulic wrench under such demanding circumstances. Further, to provide an opening into the area at the distal end of the cylinder typically requires a bore be drilled through an outer and inner cylinder, so that the outer cylinder can be plugged, causing the fluid to flow from the space between the two, into the inner cylinder. In many instances, the high pressure of the hydraulic fluid causes the plug to pop out of the outer cylinder, which in turn causes hydraulic fluid to leak, and the device to become essentially inoperable.

Accordingly, there is a need in the art for an improved system and method for restoring a hydraulic piston to an initial position.

SUMMARY OF THE INVENTION

According to one aspect, the invention is directed to a hydraulic wrench that may include a cylinder assembly disposed within a housing including first and second cylinders therein; first and second supply hoses, extending from a fluid supply, and carrying fluid therein; a swivel coupling the first and second hoses to the to the cylinder assembly; a first piston, within the first cylinder, coupled to the first hose and to a drive train, the first piston operable to transmit force through the drive train to transmit torque to a fastener to be driven by the wrench upon extending out of the first cylinder; and a second piston, within the second cylinder, coupled to the second hose and to the drive train, and operable, upon extending out of the second cylinder, to transmit force through the drive train to force the first piston into a refracted position.

Other aspects, features, advantages, etc. will become apparent to one skilled in the art when the description of the preferred embodiments of the invention herein is taken in conjunction with the accompanying drawings.

BRIEF DESCRIPTION OF THE DRAWINGS

For the purposes of illustrating the various aspects of the invention, there are shown in the drawings forms that are presently preferred, it being understood, however, that the invention is not limited to the precise arrangements and instrumentalities shown.

DETAILED DESCRIPTION OF THE PREFERRED EMBODIMENTS

In the following description, for purposes of explanation, specific numbers, materials and configurations are set forth in order to provide a thorough understanding of the invention. It will be apparent, however, to one having ordinary skill in the art that the invention may be practiced without these specific details. In some instances, well-known features may be omitted or simplified so as not to obscure the present invention. Furthermore, reference in the specification to phrases such as "one embodiment" or "an embodiment" means that a particular feature, structure or characteristic described in connection with the embodiment is included in at least one embodiment of the invention. The appearances of phrases such as "in one embodiment" or "in an embodiment" in various places in the specification do not necessarily all refer to the same embodiment.

Figure 1:
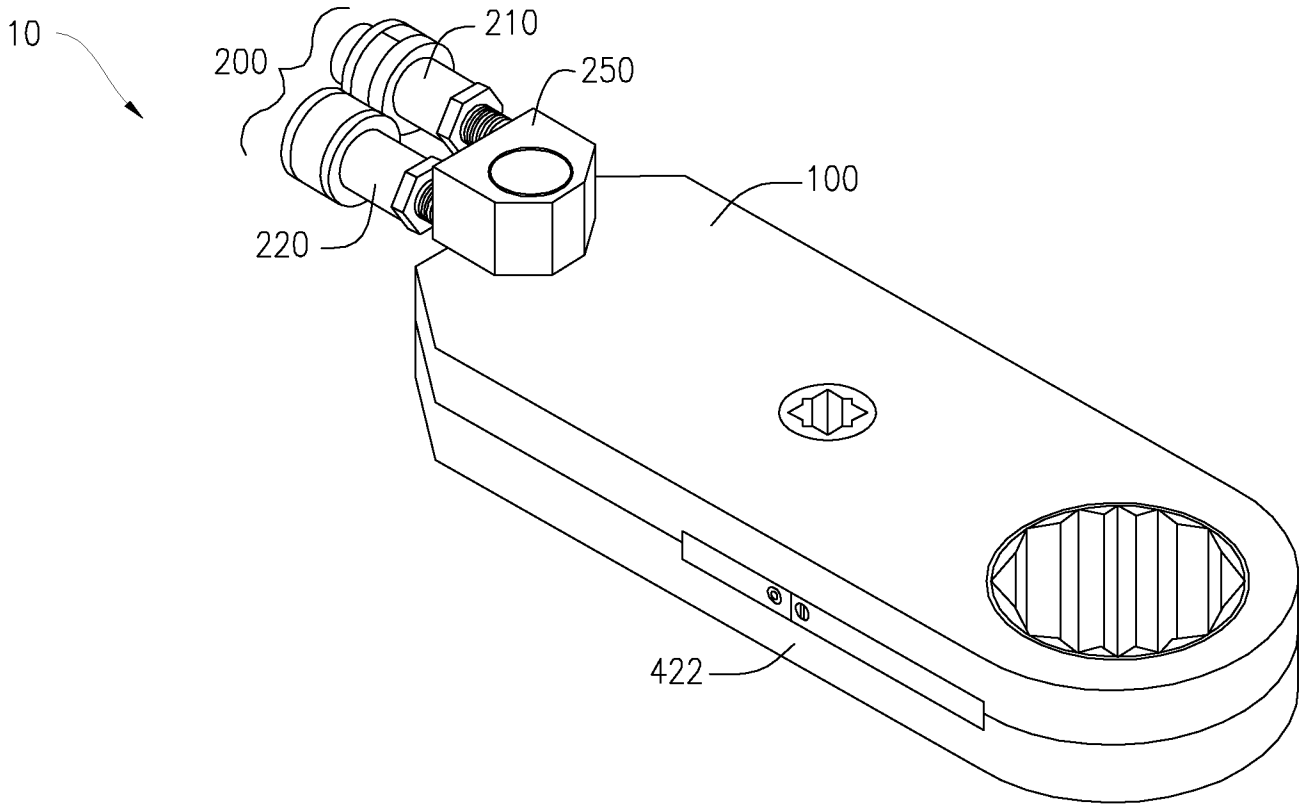
FIG. 1 is a perspective view of a hydraulic wrench in accordance with an embodiment of the present invention.

FIG. 1 is a perspective view of a hydraulic wrench 10 in accordance with an embodiment of the present invention. FIG. 1 shows hoses 210 and 220 (collectively hoses 200), housing 100 and swivel 250 (also referred to herein as a "swivel assembly").

Figure 2A:
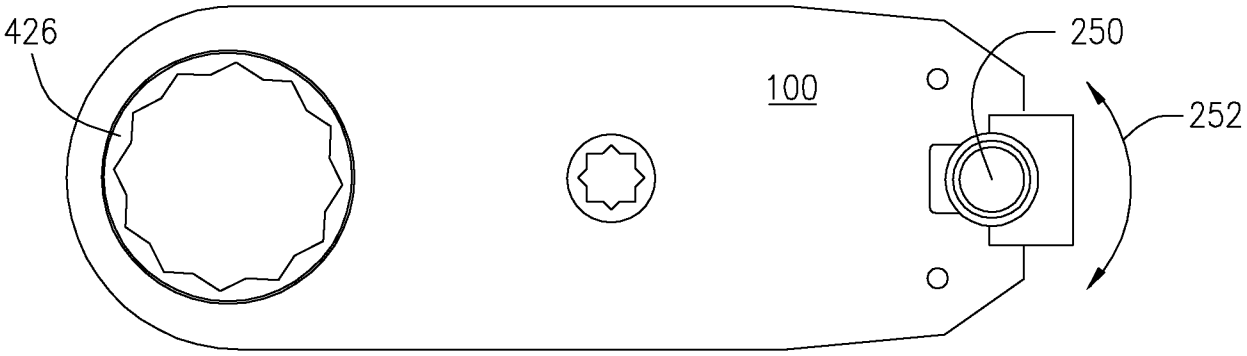
FIG. 2A is a plan view of the top of the hydraulic wrench of FIG. 1 showing one axis of rotation of a swivel assembly.
Figure 2B:
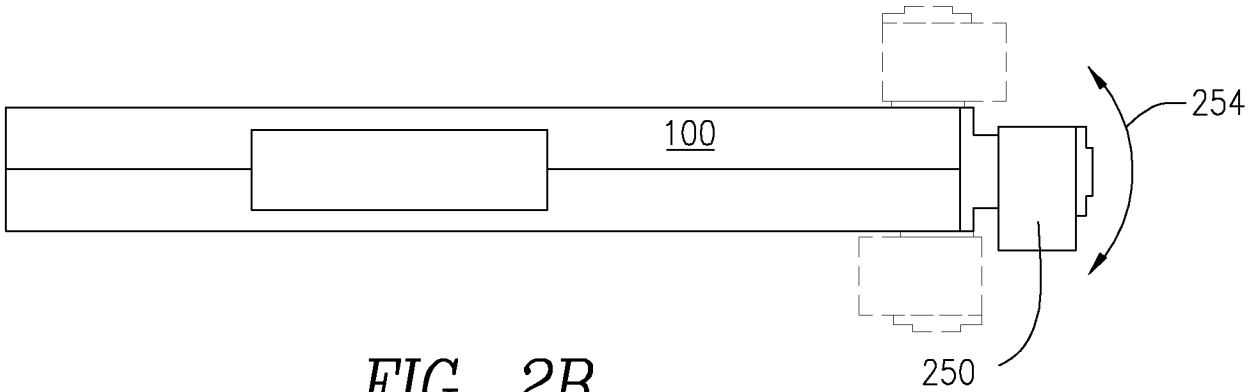
FIG. 2B is a side view of the hydraulic wrench of FIG. 1 showing another axis of rotation of the swivel assembly.

FIG. 2A is a plan view of the top of the hydraulic wrench 10 of FIG. 1 showing axis of rotation 252 of swivel assembly 250. Herein, axis 252 may be referred to as the "yaw" axis or the "lateral axis" given the relation between axis 252 and the longitudinal axis of housing 100 of wrench 10. FIG. 2B is a side view of the hydraulic wrench of FIG. 1 showing axis of rotation 254 of swivel assembly 250. Herein, axis 254 is also referred to as the "pitch axis" or "tilt axis" of rotation given the relation between axis 254 and the longitudinal axis of housing 100 of wrench 10.

Figure 3A:
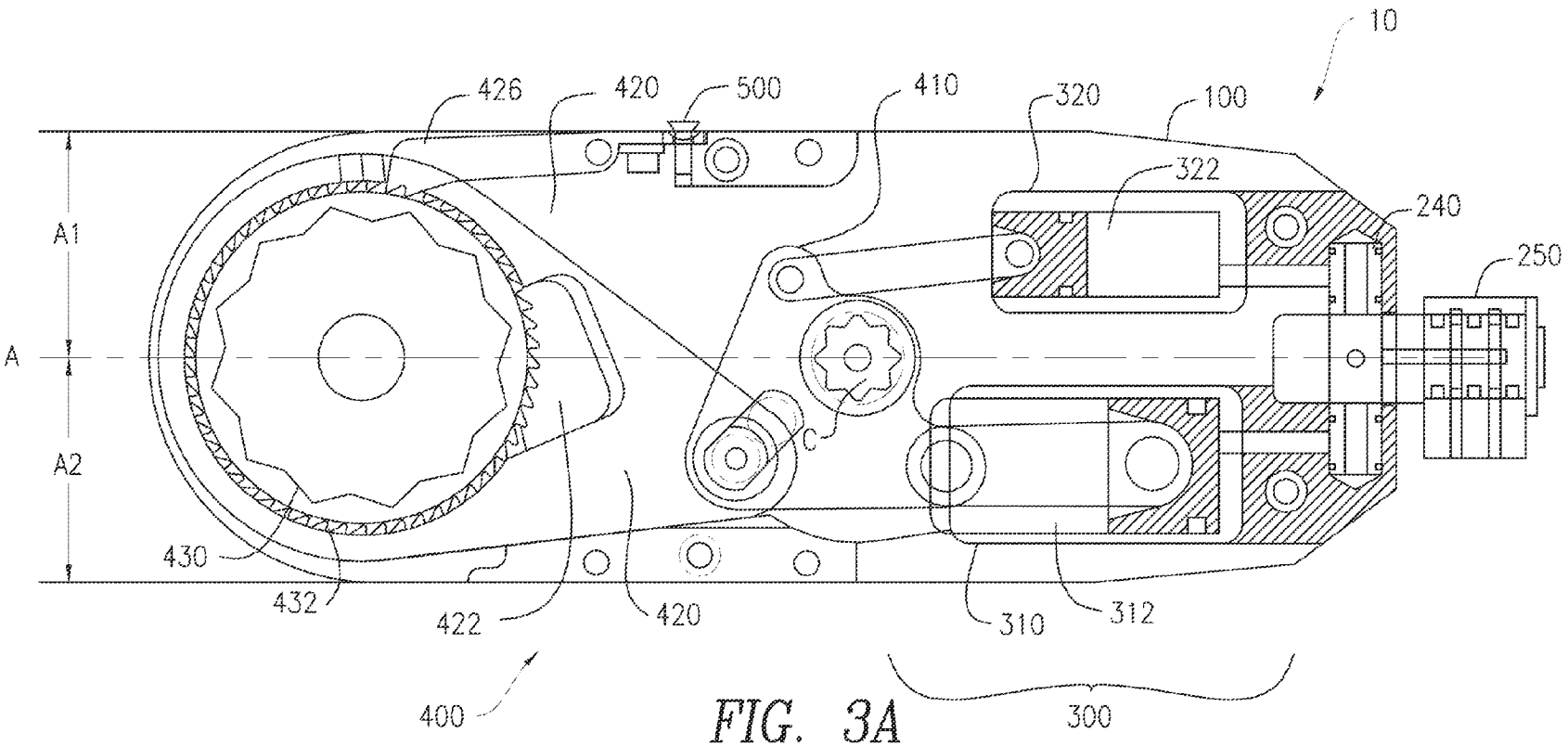
FIG. 3A is a plan view of the hydraulic wrench of FIG. 1 showing a piston assembly and a drive train thereof in accordance with an embodiment of the invention.
Figure 3B:
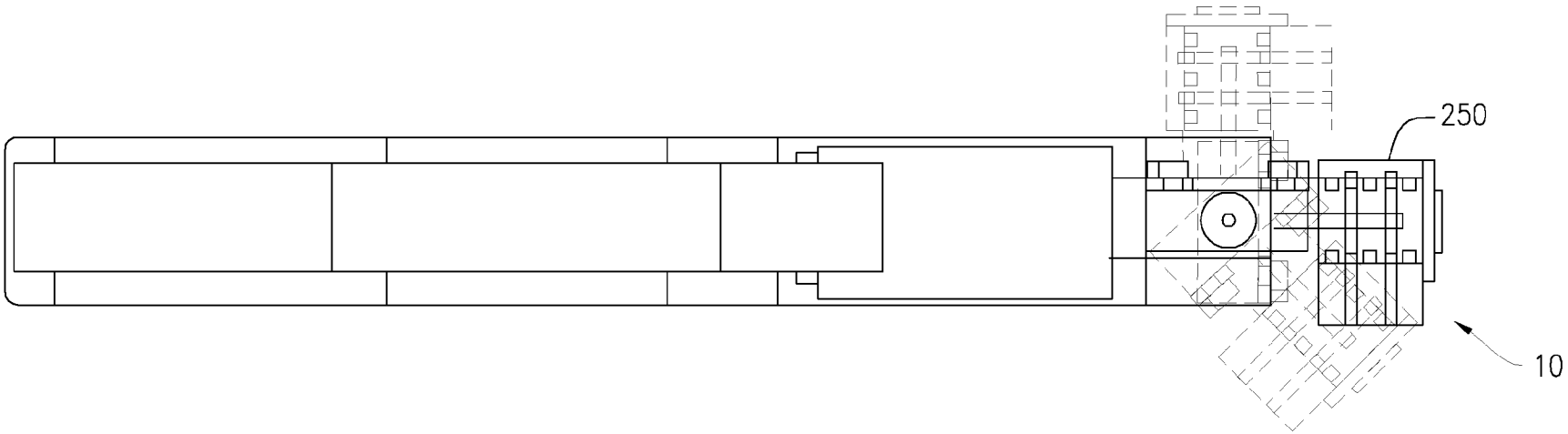
FIG. 3B is a side view of the hydraulic wrench of FIG. 3A showing the motion of the swivel assembly about a first axis.

FIG. 3A is a plan view of the hydraulic wrench 10 of FIG. 1 showing a piston assembly 300 and a drive train 400 (also referred to herein as the power train) in accordance with an embodiment of the invention. FIG. 3B is a side view of the hydraulic wrench of FIG. 3A showing the articulation of the swivel assembly about the pitch axis 254.

FIG. 3A shows a bisecting line "A" extending along the longitudinal axis of housing 100 of wrench 10. Preferably, in the embodiment of FIG. 3A, dimensions A1 and A2 on opposite sides of bisecting line A are at least substantially equal. Moreover, in addition to being substantially equal in width, the portions of housing 100 having widths A1 and A2, respectively, are preferably substantially symmetrical. More specifically, the weight and of distribution of equipment is either the same or very close to the same on both sides of the bisecting line. For instance, input drive center piece 410 and drive plate 420 preferably operate substantially symmetrically about the bisecting line A. Moreover, cylinders 310 and 320 are preferably positioned symmetrically with respect to bisecting line A. A further aspect of this embodiment is that the input hoses 200 (FIG. 1), the swivel assembly 250, and the member 430 to be driven by hydraulic wrench 10 are preferably all located on a common axis. Preferably, swivel axle 240 pivots within two distinct cylinders without a need for pressure plugs.

Figure 4:
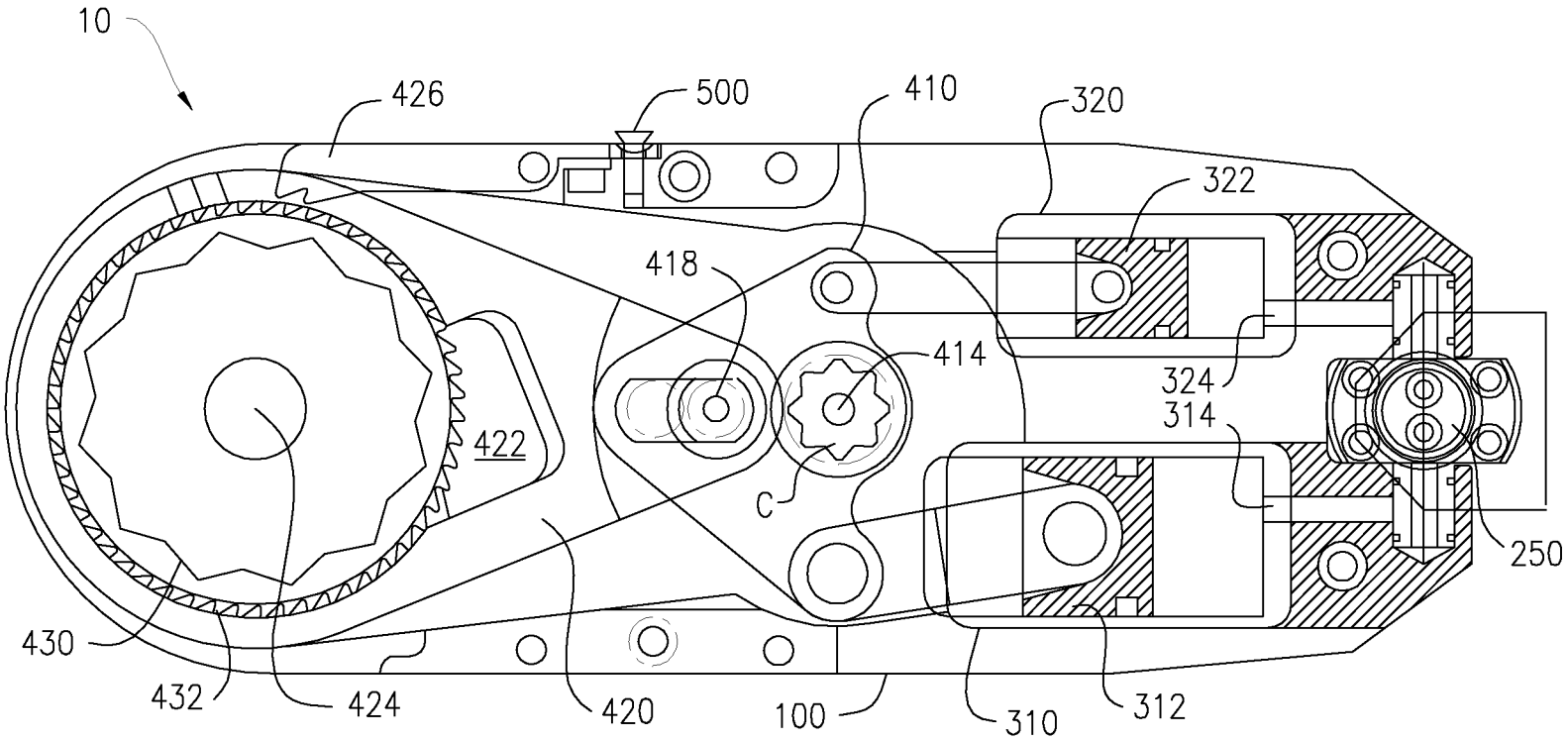
FIG. 4 is a more detailed plan view of the hydraulic wrench of FIG. 1 showing the piston assembly, the drive train, and drive member of the hydraulic wrench of FIG. 1 in accordance with an embodiment of the present invention.

FIG. 4 is a more detailed plan view of the hydraulic wrench of FIG. 1 showing the piston assembly 300, the drive train 400, and driven member 430 (which may be a fastener) of the hydraulic wrench of FIG. 1 in accordance with an embodiment of the present invention.

The features discussed below enable wrench 10 to be placed into tightly spaced areas with limited access and still deliver a high level of torque needed for various applications. The swivel feature preferably enables high pressure fluid to be provided to a point near the proximal end of housing 100 (i.e. the end of the housing at which the swivel assembly is located) even if the length of the hoses leading up to housing 100 need to be held at awkward angles with respect to the longitudinal axis of housing 100.

Moreover, the deployment of two single-acting pistons preferably obviates the need to provide pressurized fluid to distal ends (the leftmost ends of the cylinders in the views of FIGS. 3A and 4) of cylinders 310 and 320, thereby further increasing the ability to position housing 10 in tightly spaced surroundings in which delivery of pressurized fluid to distal ends of cylinders 310, 320 would be difficult. In the following, the parts and connections of the apparatus are discussed, followed by a discussion of the operation of a preferred embodiment of wrench 10.

With reference to FIGS. 3A and 4, wrench 10 may include swivel assembly 250 (also referred to herein as "swivel" 250), piston assembly 300, drive train 400, and driven member 430 (such as a fastener). Swivel assembly 250 preferably includes hinges and/or linkage suitable for providing a yaw axis of rotation 252 (rotation within a plane parallel to the top surface of housing 100) and a pitch axis (which corresponds to rotation along a "tilt" angle) axis of rotation 254 (see FIG. 2). Piston assembly 300 may include cylinder 310 and associated piston 312, and cylinder 320 and associated piston 322.

Drive train 400 may include input drive center piece 410 which may pivot about pivot point 414, drive plate 420 which may pivot about pivot point 424, pawl 422, ratchet 432, and reaction pawl 426. Drive train 400 may be operable to turn driven member 430, which may be a fastener.

The operation of wrench 10 is now discussed with reference to FIGS. 3A and 4. With reference to FIG. 4, when wrench 10 is ready to impart torque to, and perform a tightening operation on, driven member 430, a suitable switch (not shown) is activated to allow pressurized fluid into fluid port 314 of cylinder 310, which operates to force piston 312 outward (i.e. leftward in the view of FIG. 4). This begins the transfer of force through the drive train 400 during what is referred to herein as the "power stroke."

As piston 312 advances out of cylinder 310, linkage coupling piston 312 and drive center piece 410 turns input drive center piece 410 clockwise about pivot point 414. The rotation of drive center piece 410 in turn causes drive plate 420 to rotate counter-clockwise by virtue of the junction between parts 410 and 420 at pin 418. Pawl 422 is preferably rigidly attached to drive plate 420 and thus rotates with plate 420. In doing so, pawl 422 forces the teeth on ratchet 432 to rotate counter-clockwise about pivot point 424 in conjunction with the movement of drive plate 420. The movement of ratchet 432 causes driven member 430 to move counter-clockwise. In the above-described manner, the release of pressurized fluid into cylinder 310 transmits force and torque through drive train 400 to thereby impart torque and rotational motion to driven member 430.

Having discussed the forward stroke of piston 312 within cylinder 310, it remains to describe the operation of the reset stroke which forces piston 312 back into a retracted position (which corresponds to the rightmost position of piston 312 in the view of FIG. 4). By way of illustration, FIG. 3A shows piston 312 fully retracted within cylinder 310. In brief, the reset stroke is executed by implementing a forward stroke of piston 322 within cylinder 320, and using drive train 400 to force piston 312 back into a fully refracted position within cylinder 310.

When wrench 10 is ready for the reset stroke to begin, the fluid connection for fluid port 314 of cylinder 310 is preferably shifted from a supply of pressurized fluid to a receiver of exhausted fluid. Once this shift has taken place, piston 312 is preferably not being forced in either direction until the reset action of piston 322 gets under way.

Thereafter, the reverse shift is preferably performed for fluid port 324 of cylinder 320. Specifically, the fluid connection for fluid port 324 is preferably shifted from a receiver of exhausted fluid (which would have been needed for piston 322 to retract during the power stroke of piston 312) to a supply of pressurized fluid. Thus, pressurized fluid is allowed into inlet 324 of cylinder 320 causing piston 322 to extend outward (i.e. leftward in the view of FIG. 4). As piston 322 extends leftward, input drive center piece 410 is forced to rotate counter-clockwise (CCW), around pivot point 414, by virtue of the linkage coupling piston 322 with drive center piece 410. The CCW motion of drive center piece 410 causes drive plate 420 to rotate clockwise, thereby moving pawl 422 over the teeth of ratchet 432 without moving driven member 430. This ratcheting function is enabled by the provision of teeth within pawl 422 that are spring-loaded in the direction of engagement with ratchet 432. Thus, as pawl 422 retracts toward a reset position with respect to ratchet 432, the teeth of pawl 422 preferably ride over the teeth of ratchet 432 without imparting any significant torque thereto. At the same time, reaction pawl 426 preferably operates to block clockwise motion by driven member 430 and ratchet 432. Reaction pawl 426 can be disengaged using screw 500.

Moreover, as drive center piece 410 proceeds counter-clockwise, linkage coupling drive center piece 410 to piston 312 forces piston 312 toward a retracted position within cylinder 310. Preferably, the forced retraction of piston 312 exhausts the fluid in cylinder 310 through fluid port 314 to a suitable container configured to receive exhausted fluid. In this manner, piston 312 preferably gets fully reset and ready to conduct another power stroke to impart torque to driven member 430 whenever desired. Moreover, pawl 422 is preferably also fully reset and suitably engaged with the teeth on ratchet 432 so that when drive plate 420 is again rotated counter-clockwise, pawl 422 will be suitably positioned to force driven member 430 counter-clockwise.

In a preferred embodiment, the diameter, length, and thus the force that can be applied by piston 312 in cylinder 310 may exceed the corresponding characteristics of piston 322 of cylinder 320. This is because piston 312, while urged forward with hydraulic pressure, performs the force-intensive task for imparting torque to driven member 430 to tighten driven member 430 against substantial resistance. The demands on piston 322 of cylinder 320 are considerably less demanding. For example, the force of piston 322 does not need to tighten, or loosen, driven member 430.

Instead, the force of advancement of piston 322 is needed move the various parts of drive train 400 into a reset position to prepare the next power stroke by piston 312. The resistance to this movement is minimal compared to that faced by piston 312. Specifically, the advancement of piston 322 rotates drive plate 420 clockwise (which does not incur the force of rotating driven member 430) and in doing so moves pawl 422 over the teeth of ratchet 432, which requires minimal torque. The advancement of piston 322 also rotates drive center piece 410 counter-clockwise about pivot point 414 and in so doing forces piston 312 back into a fully retracted position (i.e. all the way to the right, as shown in FIG. 3A). Forcing piston 312 into a retracted position requires exhausting fluid within cylinder 310 out of fluid port 314 through the hoses connected to swivel 250 and ultimately to a suitable container (not shown).

In an alternative embodiment, wrench 10 may be used as mechanical multiplier in which input C of input drive center piece 410 may be used as an input by a tool, which tool may be machine-driven or manually driven. The mechanical multiplier effect may arise because of the selection of dimensions for input drive center piece 410 and of drive plate 420. More specifically, if the pin connection between drive center piece 410 and drive plate 420 is closer to the pivot point 414 of drive center piece 410 than to the center 424 of drive plate 420, then a mechanical advantage is obtained by rotating drive center piece 410 with a tool (not shown) over attempting to directly rotate drive plate 420 with the same tool.

Various details regarding the operation of the driving elements, links, and pins connecting various elements of the drive train 400 in addition to discussions of various torque ratios relevant to the operation of the above are discussed in U.S. Pat. No. 6,260,443 which has been incorporated by reference herein in its entirety.

It is noted from FIG. 4, for example, the force used to apply the required torque and to return the piston 312 to its initial position within cylinder 310 is not generated by introducing hydraulic fluid through a second input within cylinder 310 at a distal end (leftmost in the views of FIGS. 3A and 4) of piston 310. Instead, piston 312 is restored to its initial position by flowing hydraulic fluid into cylinder 320 to extend piston 322 outward (i.e. leftward in FIG. 3A) and using the linkage forming part of drive train 400 to force piston 312 back into its initial position. This approach eliminates the need for the holes to be plugged as discussed above with respect to the prior art. This, in turn, avoids the possibility of the plug failing and leaking hydraulic fluid out.

It is noted that the term cylinder is used to denote the compartment within which the hydraulic fluid is pressurized to provide force, and that such term therefore refers to any such compartment, even if its shape is not cylindrical. That is, the "cylinder" could be rectangular, or of any other cross sectional shape. Moreover, while the present disclosure describes the application of the cylinder arrangement of FIGS. 3A and 4 to a hydraulic wrench, it will be appreciated that the present invention is not limited to this application. Indeed, the cylinder arrangement disclosed herein may be employed with other types of hydraulically powered tools.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A hydraulic wrench having a proximal end and a distal end, comprising:

a cylinder assembly disposed within a housing including first and second cylinders therein, wherein the first and second cylinders are arranged substantially in parallel, side by side, and include respective first and second fluid ports located at proximal ends of the respective cylinders and at the proximal end of the wrench;

a swivel coupling first and second supply hoses to the cylinder assembly;

a first piston, within the first cylinder, coupled to the first hose and to a drive train, the first piston operable to transmit force through the drive train to transmit torque to a fastener to be driven by the wrench upon extending out of the first cylinder; and a second piston, within the second cylinder, coupled to the second hose and to the drive train, and operable, upon extending out of the second cylinder, to transmit force through the drive train to force the first piston into a retracted position, without moving the fastener.

2. The hydraulic wrench of claim 1 wherein the proximal ends of the cylinders are substantially aligned at a point near the proximal end of the wrench, and wherein longitudinal axes of the first and second cylinders extend from the proximal ends thereof toward the drive train and the fastener.

3. The hydraulic wrench of claim 1 wherein the two cylinders include respective pistons that actuate in substantially the same direction.

4. The wrench of claim 1 wherein the first and second cylinders positioned symmetrically with respect to a longitudinal center line of the wrench.

5. The wrench of claim 1 wherein the drive train comprises:

a drive center piece coupled to both said pistons, and including a fitting enabling the drive center piece to receive a tool as an input.

6. The wrench of claim 5 wherein the use of a tool coupled to the drive center piece enables the hydraulic wrench to serve as a mechanical multiplier for a force imparted to the tool.

* * * * *